US006523599B1

(12) United States Patent
Balliel

(10) Patent No.: US 6,523,599 B1
(45) Date of Patent: Feb. 25, 2003

(54) CASTING FURNACE WITH CENTRALLY LOCATED HEATING ELEMENT FOR PRODUCING DIRECTIONALLY SOLIDIFIED CASTINGS

(75) Inventor: Martin Balliel, Künten (CH)

(73) Assignee: Alstom (Switzerland) Ltd, Baden (CH)

( * ) Notice: Subject to any disclaimer, the term of this patent is extended or adjusted under 35 U.S.C. 154(b) by 0 days.

(21) Appl. No.: 09/556,310

(22) Filed: Apr. 24, 2000

(30) Foreign Application Priority Data

Apr. 30, 1999 (DE) ..... 199 19 869

(51) Int. Cl.[7] ..... B22D 27/04

(52) U.S. Cl. ..... 164/338.1; 164/122.1; 164/125

(58) Field of Search ..... 164/122, 122.1, 164/122.2, 123–128, 516–518, 338.1

(56) References Cited

U.S. PATENT DOCUMENTS 3,763,926 A * 10/1973 Tschinkel et al. ..... 164/338
3,810,504 A * 5/1974 Piwonka ..... 164/60
4,307,769 A * 12/1981 Hauser et al. ..... 164/4.1
5,335,711 A * 8/1994 Paine ..... 164/66.1

FOREIGN PATENT DOCUMENTS

GB 1270630 * 10/1970
GB 1 270 630 4/1972
GB 1 307 208 2/1973

* cited by examiner

*Primary Examiner*—A. Alexandra Elve
*Assistant Examiner*—Kevin McHenry
(74) *Attorney, Agent, or Firm*—Burns, Doane, Swecker & Mathis, L.L.P.

(57) ABSTRACT

A casting furnace (1) for producing castings which are directionally solidified in monocrystalline and polycrystalline form. The casting furnace (1) includes an upper heating chamber (2), which is equipped with a heating chamber wall (4) which contains at least one heater element, a lower cooling chamber (3), and contains a casting mold (11) which is moved by means of a conveyor device. Inside the heating chamber (4) there is an internal heater (6) which heats the inner surfaces of the casting pieces (11*a*), which are shielded from the casting mold (11), and thus prevents the solidification front from sloping inside the casting pieces (11*a*).

12 Claims, 3 Drawing Sheets

CASTING FURNACE WITH CENTRALLY LOCATED HEATING ELEMENT FOR PRODUCING DIRECTIONALLY SOLIDIFIED CASTINGS

FIELD OF THE INVENTION

The invention relates to a casting furnace for producing castings which are directionally solidified in monocrystalline and polycrystalline form.

BACKGROUND OF THE INVENTION

Such a casting furnace can be used to produce components which are of complicated design and can be exposed to high thermal and mechanical loads, for example guide vanes and rotor blades of gas turbines. Depending on the process conditions, the directionally solidified casting may be formed as a single crystal (SX) or may be in polycrystalline form from preferentially oriented columnar crystals (directionally solidified, DS). It is of particular importance for the directional solidification to take place-under conditions in which there is considerable heat exchange between a cooled part of a casting mold holding molten starting material and the still molten starting material. It is then possible for a zone of directionally solidified material to form with a solidification front which, as heat continues to be withdrawn, migrates through the casting mold so as to form the directionally solidified casting.

Document EP-A1-749,790 has disclosed such a process and a device for producing a directionally solidified casting. The device comprises a vacuum chamber which contains an upper heating chamber and a lower cooling chamber. The two chambers are separated by a baffle. The vacuum chamber accommodates a casting mold which is filled with a molten material. To produce parts which can be subjected to thermal and mechanical loads, as in the case of guide vanes and rotor blades of gas turbines, a nickel base superalloy, for example, is used. In the center of the baffle, there is an opening through which the casting mold is slowly moved from the heating chamber into the cooling chamber during the process, so that the casting is directionally solidified from the bottom upward. The downward movement is brought about by means of a drive rod on which the casting mold is mounted. The base of the casting mold is of water-cooled design. Beneath the baffle there are means for generating and guiding a gas flow. Through the flow of gas next to the lower cooling chamber, these means provide additional cooling and thus a greater temperature gradient at the solidification at the front.

A similar process which, in addition to heating and cooling chambers, operates with additional gas cooling, is known, for example, from U.S. Pat. No. 3,690,367.

A further process for producing directionally solidified castings with heating and cooling chambers is also described, for example, in document U.S. Pat. No. 3,532,155.

A further process for producing a directionally solidified casting is known from document U.S. Pat. No. 3,763,926. In this process, a casting mold which has been filled with a molten alloy is immersed continuously into a bath which has been heated to approx. 260° C. This results in particularly rapid dissipation of heat from the casting mold. This and other similar processes are known as LMC (liquid metal cooling).

In all the abovementioned process variants, the upper heating chamber comprises one or more heater elements which surround the casting mold located therein from the outside and are usually of cylindrical form, and a thermal insulation which covers the heating chamber at the top. To achieve improved productivity and a uniform quality of casting, particularly for the production of turbine blades as many casting pieces as possible are arranged symmetrically in a casting mold on an imaginary circle or in a similar manner.

A significant drawback of the abovementioned processes is that, owing to the externally arranged heater, in the heating chamber heat is preferentially introduced into those surfaces of the casting mold which face outward. Particularly in the case of vacuum furnaces, the heat transfer takes place only by means of radiation. If a plurality of castings are arranged in the form of a circle or the like in a casting mold, the casting mold shadows some of the thermal radiation coming from the heater, so that those surfaces of the casting mold which face inward into the center of the heating chamber are cooler than the surfaces which face outward toward the heater element. This results in a sloping solidification front in the casting pieces, i.e. the solidification front deviates significantly from the horizontal position which is desired during the solidification process. In directionally solidified, polycrystalline casting pieces, it is a drawback for the grain boundaries to be sloping, resulting in undesirable coarsening of the grains. In the case of single crystal and directionally solidified polycrystalline casting pieces, this sloping position of the solidification front may result in undesirable flawed grains. In the case of many directionally solidifying alloys, a sloping position of the solidification front also promotes the formation of undesirable flaws, known as freckles, i.e. a series of small flawed grains arranged in the vertical direction.

SUMMARY OF THE INVENTION

The object of the invention is to eliminate the described drawback and to provide a casting furnace for producing directionally solidified castings which avoids the sloping position which occurs at the solidification front.

According to the invention there is provided a casting furnace for producing castings which are directionally solidified in monocrystalline and polycrystalline form, comprising an upper heating chamber with a heating chamber wall, the chamber contains at least one heater element, a furnace cover, a lower cooling chamber, a casting mold with casting pieces, a conveyor device for the casting mold, and an internal heater which contains at least one heater element and is arranged in the middle area of the upper heating chamber centrally between the casting pieces.

This internal heater heats the cooler surfaces of the mold, facing inward into the center of the heating chamber, so that the solidification front runs substantially horizontally through the casting pieces. As a guideline, the internal heater, which may comprise one or more individual heaters, should be at the same temperature as the outer heater element(s) at a similar level in the heating chamber.

Advantageously, the internal heater is arranged mechanically on the casting furnace cover. The lower area is thermally insulated with respect to the lower cooling chamber, in order to avoid heat loss to this chamber and to produce a greater temperature gradient at the solidification front. To provide the insulation, an internal baffle may be arranged in the middle area between the upper heating chamber and the lower cooling chamber. The casting furnace according to the invention makes it possible to achieve increased productivity and a more uniform quality of casting, since a larger number of casting pieces can be arranged in the casting furnace without suffering a loss of quality such as that which is known from the prior art. The internal heater may be designed in the form of a rod or a hollow cylinder. In the case of a hollow cylindrical heater, the casting mold is filled from the top through the heater with the aid of a funnel, in which case the inner surface of the heater may be thermally insulated.

BRIEF DESCRIPTION OF THE DRAWINGS

Preferred embodiments of the invention are illustrated in the accompanying drawings, in which.

DETAILED DESCRIPTION OF THE INVENTION

Figure 1:
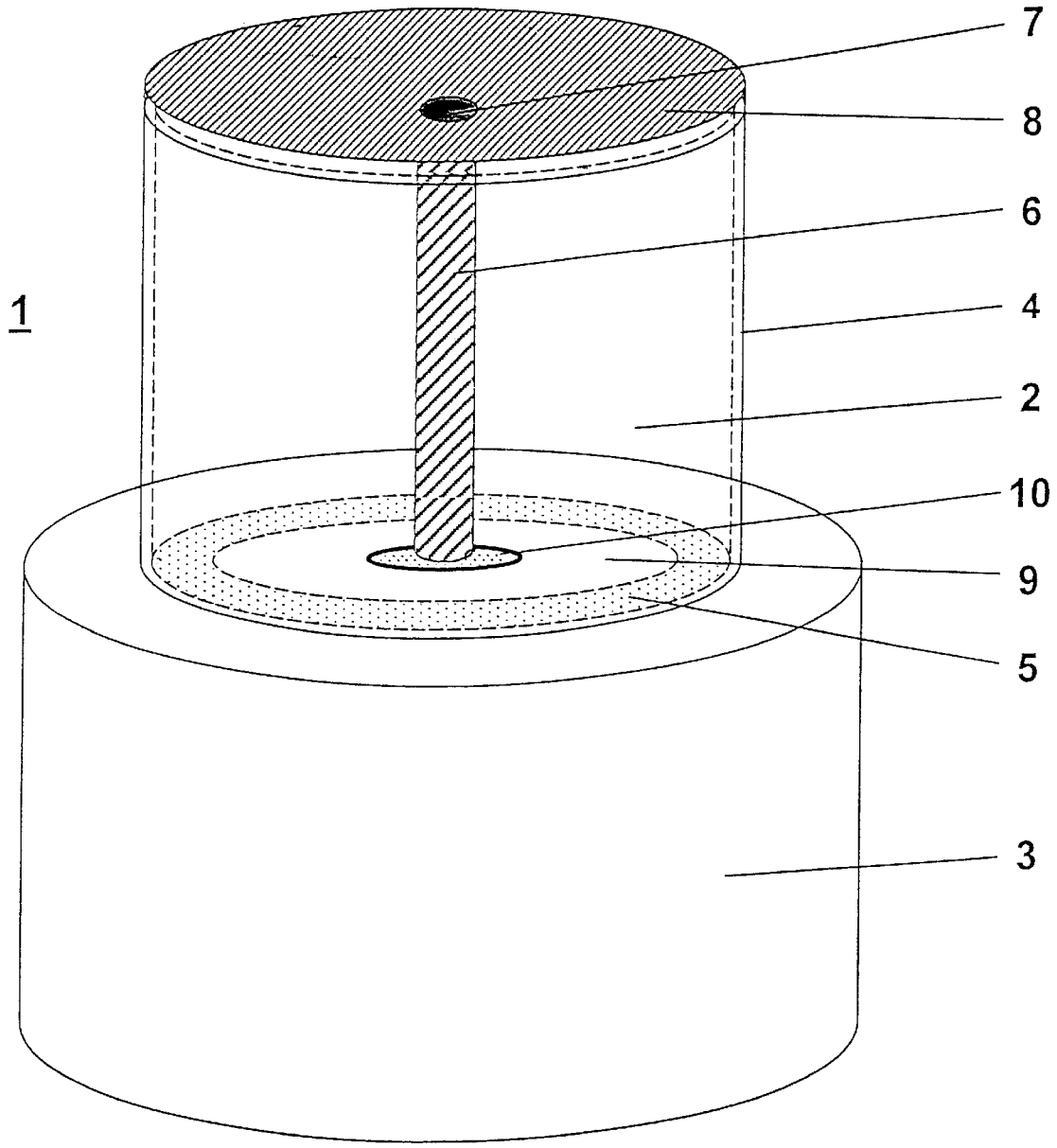
FIG. 1 is a perspective view of a casting furnace according to the invention with an internal heater in the form of a rod.

Only those parts which are essential to the invention are illustrated. Identical components are provided with the same reference numerals throughout the various drawings.

FIG. 1 shows an embodiment of a casting furnace 1 according to the invention for producing castings which are directionally solidified in monocrystalline and polycrystalline form, such as those used for guide vanes and rotor blades of gas turbines. The casting furnace 1 comprises an upper heating chamber 2 and a lower cooling chamber 3. The two chambers 2, 3 may be connected to a vacuum system (not shown), in order to evacuate the chambers 2, 3. The upper heating chamber 3 is of cylindrical form and has a heating chamber wall 4 which contains at least one heater element. At the top, the upper heating chamber 3 is delimited by a furnace cover 8. In the exemplary embodiment shown, a baffle 5 is arranged between the upper heating chamber 2 and the lower cooling chamber 3. Cooling devices (not shown in more detail) are located inside the cooling chamber 3. These devices may, for example, be a gas cooling system which is known from laid-open specification EP-A1-749,790, an LMC cooling system or a hollow space with cooled walls. A casting mold 11 with casting pieces 11*a*, into which the molten material is cast, is usually arranged symmetrically in an imaginary circle or in a similar way in the inner space 9 of the heating chamber 2. For the sake of simplicity, the casting mold 11, the device for filling the casting mold 11 with the alloy and the conveyor device which guides the casting mold 11 from the heating chamber 2 into the cooling chamber 3 during the process to produce the casting pieces 11*a*, are omitted in FIG. 1. These are standard devices which are known from the prior art.

According to the invention, an internal heater 6 is located in the middle of the heating chamber 2. This internal heater 6 is advantageously held mechanically on a mount 7 in the area of the upper furnace cover 8. The energy supply, e.g. electric current in the case of a resistance heater, can also be supplied from this mount. The centrally arranged internal heater 6 heats the cooler surfaces of the casting mold 11, which face inward into the center of the heating chamber 2, so that the solidification front runs substantially horizontally through the casting pieces. As a guideline, the central heater 6, which may comprise one or more individual heater elements, should be at a temperature of the same order of magnitude as the at least one heater element of the heating chamber wall 4 at a similar level in the heating chamber 2.

The internal heater 6 may advantageously be covered at the bottom by a thermal insulation. In FIG. 1, to provide the insulation, in addition to the thermal insulation at the bottom end of the internal heater 6 an additional internal baffle 10 is used for the inner area between the upper heating chamber 2 and the lower cooling chamber 3. This insulation reduces the heat losses from the inwardly facing surfaces of the casting mold 11 to the cooling chamber 3, since the inner space 9 is closed at the bottom. It is thus possible to establish a higher temperature gradient in the casting pieces 11*a*.

For processes which operate as described in documents EP-A1-749,790 or U.S. Pat. No. 3,532,155, the central heater 6 advantageously extends from the upper area of the heating chamber 2 to just above the cooling chamber 3.

In the case of LMC processes, as known, for example, from document U.S. Pat. No. 3,763,926, the central heater 6 advantageously extends from the upper area of the heating chamber 2 to just above the cooling bath surface or into the area of the baffle 5, in order to avoid direct contact with the cooling liquid.

The internal heater 6 may be in the form of a rod and arranged centrally, which makes it difficult to cast molten material centrally in the area of the upper heating space cover and in many cases practically prevent this possibility, thus making it difficult to achieve precise symmetry of the casting mold and thus a uniform cast quality of all the casting pieces arranged on a circle or in similar form in a mold. However, the advantages of the process significantly outweigh this slight drawback.

Figure 2:
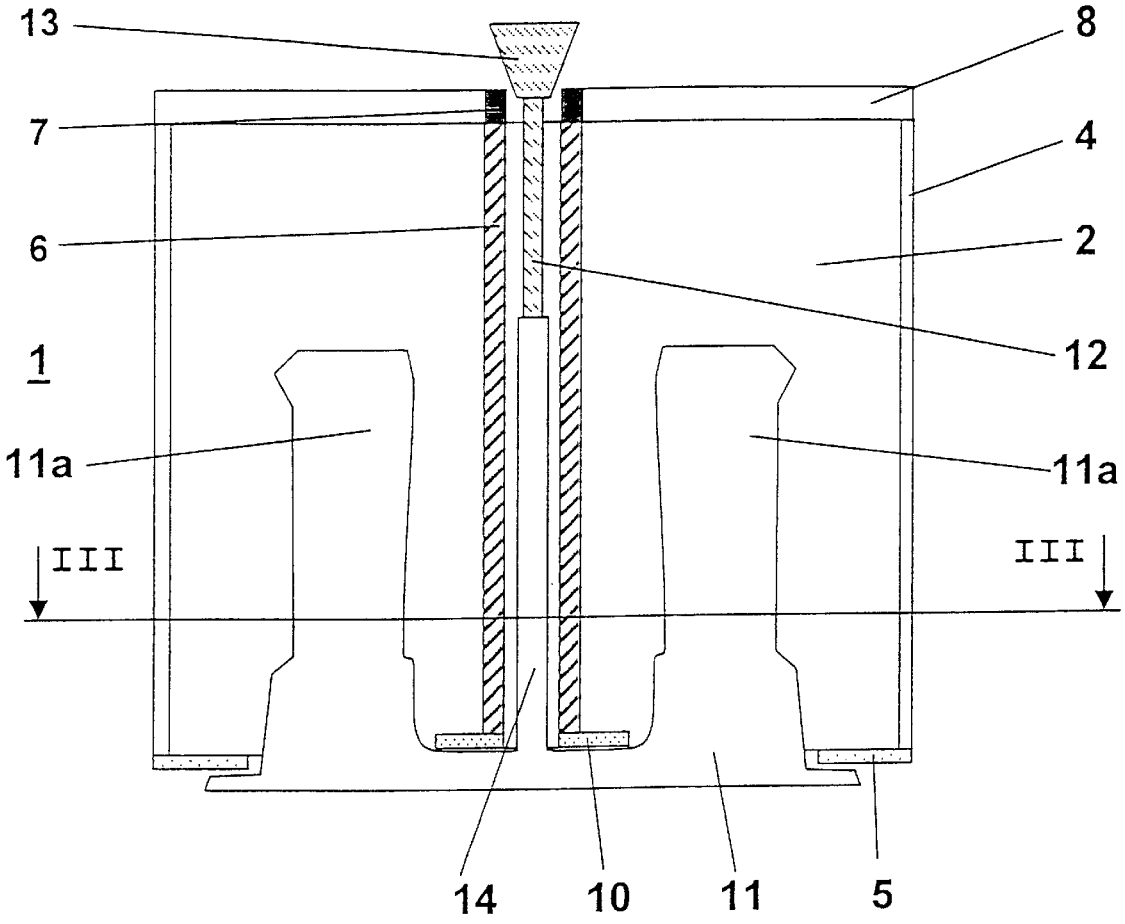
FIG. 2 is a longitudinal cross-sectional view through a casting furnace according to the invention with a hollow cylindrical internal heater and a filling funnel.

FIG. 2 shows the embodiment of the casting furnace 1 according to the invention in longitudinal section. The internal heater 6 is advantageously in the form of a hollow cylinder and is arranged centrally, with the result that the symmetry of the casting mold 11 and therefore a uniform cast quality of all the casting pieces 11*a* arranged on a circle or the like in a casting mold 11 is not disrupted. In this case, molten casting material can be cast into a funnel 13 which is positioned centrally at the top end of the central heater 6. The molten material is then guided through a connecting tube 12 to the casting pieces 11*a* inside the internal heater 6 which is of hollow cylindrical design. A tubular extension 14 of the casting mold 11 is located in the area of the bottom end of the connecting tube 12. The tubular extension 14 should be at least as high as the filled height of the casting pieces 11*a*, in order to prevent overflow while the molten material is being introduced. To reduce the thermal load on the casting funnel 13, the connecting tube 12 and the tubular extension 14, thermal insulation with respect to the funnel 13, to the connecting tube 12 and to the tubular extension 14 may be arranged both at the top end and on the inner surfaces of the hollow cylindrical internal heater 6.

Figure 3:
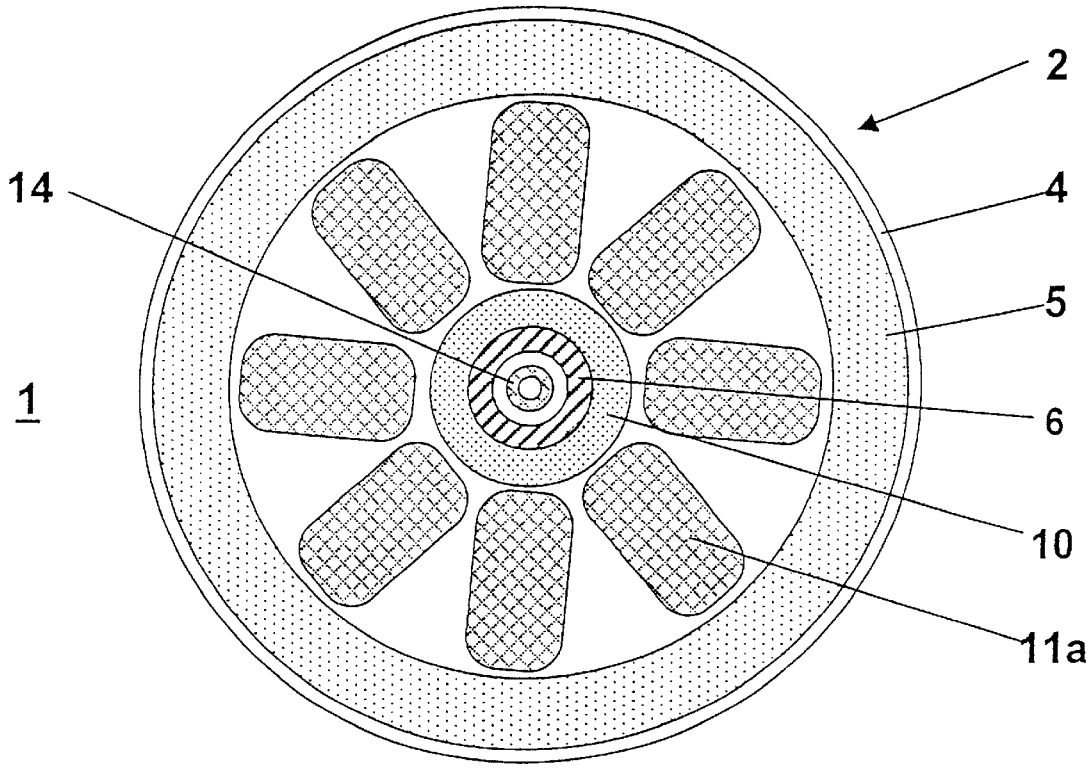
FIG. 3 shows a cross section on line III—III of FIG. 2.

FIGS. 3 show a cross section on line III—III from FIG. 2 through the upper heating chamber 2 of a casting furnace 1 according to the invention. At least one heater element is arranged in the heating chamber wall 4 of the upper cylindrical heating chamber 2. The internal heater 6, which in FIG. 3 is designed as a hollow cylinder, is located in the inner space of the upper cooling chamber 2. In the embodiment shown in FIG. 3, the tubular extension 14 can be seen in the middle of the hollow cylindrical internal heater 6, which extension is used for central filling of the casting pieces 11*a*.

The funnel 13, which is used to fill the casting pieces, and the connecting elements from the funnel 13 via the connecting tube 12 to the casting pieces 11*a* are not shown in FIG. 3. The internal baffle 10 is located beneath the internal heater 6. The casting pieces 11*a* are arranged around the internal heater 6 inside the upper heating chamber 2. FIG. 3 also shows the baffle 5 which is arranged below the upper heating chamber 2 in round form to provide insulation with respect to the lower cooling chamber 3, which is not shown in FIG. 3. As a result of the internal heater 6 being arranged in the middle of the upper heating chamber 2, the inner surfaces of the casting pieces 11*a* are heated to the same extent as the outer surfaces facing toward the heating chamber wall 4, and the internal shielding from the radiation from the heating chamber 4 by the casting pieces 11*a* themselves is compensated for.

Figure 3A:
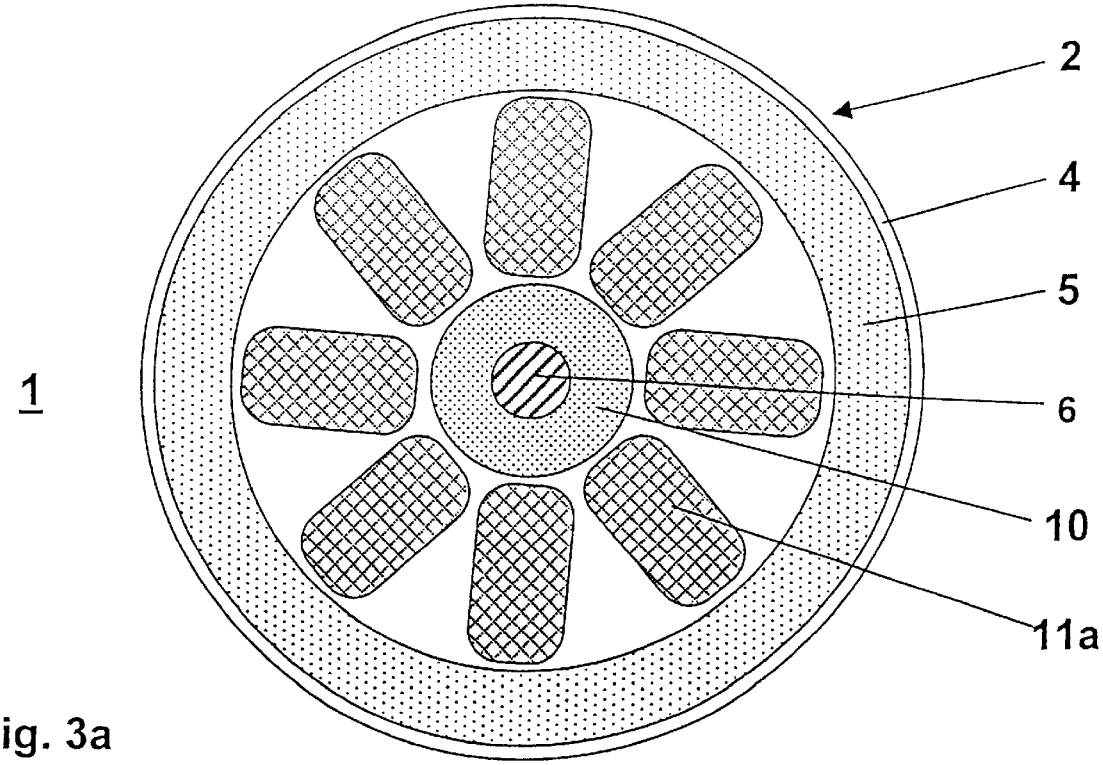
FIG. 3*a* shows a further embodiment of FIG. 3 in cross section through a casting furnace according to the invention with an internal heater in the form of a rod.

FIG. 3*a* shows a cross section through a second embodiment of the casting furnace 1 according to the invention. It substantially corresponds to FIG. 3, but contains an internal heater 6 which is in the form of a rod. The device for filling the casting pieces 11*a*, funnel, connecting tube, etc., via the center of the internal heater 6 are consequently not illustrated.

The casting furnace 1 according to the invention can be used to achieve increased productivity and a more uniform cast quality, since a larger number of casting pieces 11*a* can be arranged in the casting furnace 1 without suffering a loss of quality such as that which is known from the prior art, since the internal heater 6 heats the casting pieces 11*a* from the inside and thus compensates for the shielding (produced by the casting pieces 11*a* themselves) from the radiation from the heating chamber wall 4.

Naturally, the invention is not limited to the exemplary embodiment described, but rather relates in general terms to casting furnaces for producing castings which are directionally solidified in monocrystalline and polycrystalline form.

What is claimed is:

1. A casting furnace for producing castings which are directionally solidified in monocrystalline or polycrystalline form, comprising an upper heating chamber with a heating chamber wall, the heating chamber contains at least one heater element, a furnace cover, a lower cooling chamber, a casting mold with a plurality of individual casting mold bodies and having an empty space between each individual mold body, a conveyor device for the casting mold, and an internal heater, which contains at least one heater element and is arranged in the middle area of the upper heating chamber centrally between the casting mold bodies with a direct line of sight between said heating elements and said mold bodies such that an uniform temperature is maintained around each individual mold body, wherein the internal heater is arranged in a middle area of the upper heating chamber and is of hollow cylindrical configuration, and above the internal heater there is a funnel which, via a connecting tube and a tubular extension of the casting mold, is connected to the casting mold in such a way that it is possible to fill the casting mold bodies via the funnel, the connecting tube and the tubular extension through the hollow cylindrical heater.

2. The casting furnace as claimed in claim 1, wherein the internal heater arranged in the middle area of the upper heating chamber is attached to the furnace cover, where it is connected to an energy supply.

3. The casting furnace as claimed in claim 1, further comprising a thermal insulation arranged below the internal heater in a middle area of the upper heating chamber in order to prevent heat loss from the internal heater to the lower cooling chamber.

4. The casting furnace as claimed in claim 1, arranged below the internal heater between the lower cooling chamber and the upper heating chamber.

5. The casting furnace as claimed in claim 1, wherein the internal heater is arranged in a middle area of the upper heating chamber and is in the form of a rod.

6. The casting furnace as claimed in claim 1, wherein a thermal insulation with respect to the funnel and/or the connecting tube and/or the tubular extension is arranged on the inner surfaces of the internal, hollow cylindrical heater.

7. The casting furnace as claimed in claim 1, wherein the internal heater during operation of the casting furnace, is at a temperature of the same order of magnitude as the at least one heater element of the outer heating chamber of the heating chamber at a similar height.

8. A casting furnace for producing castings which are directionally solidified in monocrystalline or polycrystalline form, the casting furnace comprising an upper heating chamber with a heating chamber wall containing at least one heater element;

a furnace cover;

a lower cooling chamber separated from the upper cooling chamber by a baffle;

a casting mold with a plurality of individual casting mold bodies and having a connection between adjacent mold bodies located on a lower cooling chamber side of the baffle such that an empty space is between each individual mold body;

a conveyor device for the casting mold; and an internal heater comprising at least one heater element and arranged in a middle area of the upper heating chamber centrally between the casting mold bodies.

9. The casting furnace of claim 8, wherein the empty space is within the upper heating chamber.

10. The casting furnace of claim 8, wherein each mold body is in a direct line of sight with both the heater element of the heating chamber wall and the heater element of the internal heater such that an entire mold body is heated to the same extent.

11. The casting furnace of claim 8, wherein, during operation of the casting furnace, the heater element of the heating chamber wall and the heater element of the internal heater are at a temperature of a same order of magnitude at a similar height in the heating chamber.

12. The casting furnace of claim 8, wherein an internal shielding by the mold bodies from radiative heat from the heater element of the heating chamber wall is compensated for by the internal heater.

* * * * *